US008013507B2

(12) United States Patent
Uchiyama

(10) Patent No.: US 8,013,507 B2
(45) Date of Patent: Sep. 6, 2011

(54) COLD CATHODE FLUORESCENT LAMP WITH PHOSPHOR LAYER FORMED OF PHOSPHOR PARTICLES AND A BONDING AGENT INCLUDING BORON OXIDE, FORMED ON AN INNER SURFACE OF A GLASS TUBE THEREOF

(75) Inventor: Norikazu Uchiyama, Minamiboso (JP)

(73) Assignee: Hitachi Displays, Ltd., Chiba (JP)

( * ) Notice: Subject to any disclaimer, the term of this patent is extended or adjusted under 35 U.S.C. 154(b) by 363 days.

(21) Appl. No.: 12/266,576

(22) Filed: Nov. 7, 2008

(65) Prior Publication Data

US 2009/0121612 A1 May 14, 2009

(30) Foreign Application Priority Data

Nov. 9, 2007 (JP) ..... 2007-292377

(51) Int. Cl.
*H01J 1/62* (2006.01)
*H01J 63/04* (2006.01)

(52) U.S. Cl. ..... 313/485; 313/486; 313/483

(58) Field of Classification Search ..... None
See application file for complete search history.

(56) References Cited

U.S. PATENT DOCUMENTS 4,691,140 A * 9/1987 Sakakibara et al. ..... 313/486
5,958,591 A * 9/1999 Budd ..... 428/403
7,550,911 B2 * 6/2009 Terada et al. ..... 313/489
2009/0268429 A1 * 10/2009 Hashimoto et al. ..... 362/97.1

FOREIGN PATENT DOCUMENTS

JP 64-021856 1/1989
WO WO 2007/055391 5/2007

* cited by examiner

*Primary Examiner* — Toan Ton
*Assistant Examiner* — Britt Hanley
(74) *Attorney, Agent, or Firm* — Antonelli, Terry, Stout & Kraus, LLP.

(57) ABSTRACT

A cold cathode fluorescent lamp which makes a step dedicated to the acquisition of advantageous effects unnecessary without lowering an optical flux maintaining factor and, at the same time, prevents peeling-off of a phosphor layer in a step of bending light transmitting glass tube is provided. The cold cathode fluorescent lamp includes a light-transmitting glass tube, a phosphor layer which is formed on an inner surface of the light-transmitting glass tube, mercury and a rare gas which is filled in the inside of the light-transmitting glass tube, and cold cathodes which are arranged in a sealed manner in both end portions of the light-transmitting glass tube in a state that the cold cathodes face each other in an opposed manner, wherein the phosphor layer is constituted of a plurality of phosphor particles and a bonding agent. The bonding agent is made of aluminum oxide and boron oxide. The phosphor particles are covered with the bonding agent by coating. The phosphor particles and the bonding agent are bonded to the inner surface of the light-transmitting glass tube thus protecting surfaces of the phosphor particles with aluminum oxide.

3 Claims, 3 Drawing Sheets

COLD CATHODE FLUORESCENT LAMP WITH PHOSPHOR LAYER FORMED OF PHOSPHOR PARTICLES AND A BONDING AGENT INCLUDING BORON OXIDE, FORMED ON AN INNER SURFACE OF A GLASS TUBE THEREOF

CLAIM OF PRIORITY

The present application claims priority from Japanese application serial No. 2007-292377, filed on Nov. 9, 2007, the content of which is hereby incorporated by reference into this application.

BACKGROUND OF THE INVENTION

1. Field of the Invention

The present invention relates to a cold cathode fluorescent lamp which is used as a light source of a liquid-crystal-display-use backlight device such as a liquid crystal monitor or a liquid crystal television receiver set, and more particularly to the bonding structure of a phosphor layer which is formed on an inner surface of a light transmitting glass tube.

2. Description of the Related Art

In general, a cold cathode fluorescent lamp is configured such that a phosphor layer is formed on an inner surface of a light transmitting glass tube, cold cathodes are arranged in the inside of the glass tube as electrodes, and a rare gas (also referred to as an inert gas) and a trace amount of mercury are sealed in the inside of the glass tube. The cold cathode fluorescent lamp radiates light when a high voltage is applied between electrodes arranged at both ends of the glass tube.

In an image display device which adopts a non-light-emitting liquid crystal display panel, an electronic latent image which is formed on the liquid crystal display panel is visualized by mounting an external lighting means on the liquid crystal display panel. As the external lighting means, except for the structure which utilizes a natural light, a lighting device is mounted on a back surface or a front surface of the liquid crystal display panel. Particularly, a display device which requires high brightness adopts the structure which mounts a lighting device on the back surface of the liquid crystal display panel as a mainstream. Such a lighting device is referred to as a backlight.

The backlight is roughly classified into a side-edge backlight and a direct backlight. The side-edge backlight is configured such that a linear light source represented by a cold cathode fluorescent lamp is arranged along a side edge portion of a light guide plate formed of a transparent plate. The side-edge blacklight is popularly used in a display device for a personal computer or the like which is required to satisfy the reduction of thickness. On the other hand, in a large-sized liquid crystal display device such as a display device used in a display monitor or a television receiver set, a direct backlight is popularly adopted. The direct backlight structure is configured such that the lighting device is arranged directly below a back surface of the liquid crystal display panel.

A general cold cathode fluorescent lamp which is used in such a lighting device is configured such that a pair of cold cathodes is arranged on both end portions of a light transmitting glass tube, a phosphor film is formed on an inner peripheral surface of the glass tube by coating, and mercury and a rare gas are sealed in the inside of the glass tube. Further, when a high voltage is applied between the cold cathodes arranged on both end portions of the glass tube, a discharge is generated in the inside of the glass tube so that ultraviolet rays having mainly a wavelength of 254 nm are generated due to the radiation by excitation of mercury. Phosphor is excited by the ultraviolet rays and radiates a visible light which forms an optical flux of emitted light.

In general, it is known that an optical flux maintenance factor of the cold cathode fluorescent lamp is gradually lowered due to lighting of the lamp for a long time. Along with the increase of an electric current which flows in the cold cathode fluorescent lamp for enhancing the brightness, such tendency becomes more apparent.

It is considered that the optical flux maintenance factor is lowered due to the following reasons. The first reason is that the transmissivity of the visible light of the light transmitting glass tube per se is lowered due to the coloration attributed to ultraviolet rays or the absorption of mercury. Further, the second reason is that the phosphor receives an impact of mercury ions at the time of lighting and hence, a surface of the phosphor is degenerated or mercury is adhered to and remains on the surface of the phosphor whereby a light emitting amount is decreased.

Accordingly, for preventing the deterioration of the light transmitting glass tube, generally, a glass tube which hardly deteriorates is used or a protective film made of material such as metallic oxide is formed on an inner surface of the glass tube.

On the other hand, for preventing the deterioration of phosphor, a technique which suppresses the deterioration of phosphor by forming a phosphor layer after forming a continuous film made of metallic oxide on phosphor powder is disclosed in JP-A-7-316551 (patent document 1). Further, a technique which suppresses the deterioration of the phosphor and enhances an optical flux maintenance factor by using a bonding agent which is obtained by mixing metallic borate and aluminum oxide particles which are hardly adhered or bonded to mercury is disclosed in JP-A-1-21856 (patent document 2).

SUMMARY OF THE INVENTION

However, although the above-mentioned existing technique is effective to the prevention of the deterioration of the light transmitting glass tube, the technique is not effective to the prevention of the deterioration of the phosphor and hence, there exists a drawback that a step of forming a protective film is necessary. Further, although the technique described in patent document 1 is effective to the prevention of the deterioration of the phosphor, the technique is not effective to the prevention of the deterioration of light transmitting glass tube and hence, there exists a drawback that a pretreatment with respect to the phosphor is necessary.

Further, with respect to the technique described in the above-mentioned patent document 2, an effect for protecting the phosphor and the light transmitting glass tube is imparted to the bonding agent and hence, the technique is advantageous in that other particular step is unnecessary. However, metallic borate used in the technique is liable to be easily adhered or bonded to mercury thus increasing the consumption of mercury necessary for radiating ultraviolet rays, or the phosphor layer per se is colored thus interrupting a visible light and ultraviolet rays necessary for exciting phosphor. In this manner, although the technique can acquire the advantageous effects to some extent compared to a case in which the technique is not adopted, there has been a drawback that the advantageous effect is less than optimal.

Here, as a technique similar to the technique disclosed in patent document 2, there has been known a technique which uses a bonding agent made of only aluminum oxide. Aluminum oxide is a material generally used as an inorganic bonding agent for various applications also in other technical fields. When aluminum oxide is used as the bonding agent, compared to a case disclosed in patent document 2, the bonding agent does not include metallic borate and hence, further advantageous effects can be expected. However, a bonding action is derived only from a Van der Waals attraction and hence, aluminum oxide is fragile to a stress of a fixed value or more. Particularly, with respect to a U-shaped or L-shaped fluorescent lamp, in a step of bending a light transmitting glass tube into a U-shape or an L-shape, a phosphor layer formed on an inner surface of the light transmitting glass tube is peeled off due to the expansion and the contraction of aluminum oxide.

The present invention has been made to overcome the above-mentioned drawbacks of the related art, and it is an object of the present invention to provide a cold cathode fluorescent lamp which makes a step dedicated to the acquisition of advantageous effects unnecessary without lowering an optical flux maintaining factor and, at the same time, prevents peeling-off of a phosphor layer in a step of bending light transmitting glass.

To achieve the above-mentioned objects, the present invention is directed to a cold cathode fluorescent lamp which includes a light transmitting glass tube in which a rare gas and mercury are sealed, a pair of cold cathodes which is arranged in both end portions of the glass tube in a sealed manner in a state that the cold cathodes face each other in an opposed manner, a pair of power lead lines each of which has one end thereof connected to the cold cathode and another end thereof led out to the outside of the glass tube in a hermetically sealed manner, and a phosphor layer which is formed on an inner surface of the glass tube, wherein the phosphor layer is constituted of a plurality of phosphor particles and a bonding agent, the bonding agent is made of aluminum oxide and boron oxide, and the plurality of phosphor particles are bonded to the inner surface of the glass tube in a state that the plurality of phosphor particles are covered with the bonding agent by coating. Accordingly, surfaces of the phosphor particles are covered with aluminum oxide by coating and hence, the surfaces of the phosphor particles are protected by aluminum oxide whereby it is possible to overcome the drawbacks of the related art.

Further, another cold cathode fluorescent lamp according to the present invention is, in the above-mentioned constitution, preferably characterized in that an amount of the bonding agent in the phosphor layer is set to a value which falls within a range from 2 wt % to 10 wt % with respect to a total amount of the phosphor.

Further, another cold cathode fluorescent lamp according to the present invention is, in the above-mentioned constitution, preferably characterized in that a ratio of boron oxide in the bonding agent is set to a value which falls within a range from 6 wt % to 10 wt % of a total amount of aluminum oxide and boron oxide.

Further, another cold cathode fluorescent lamp according to the present invention is, in the above-mentioned constitution, preferably characterized in that a primary particle size (single-body particle size) of aluminum oxide is set to 200 nm or less.

Here, the present invention is not limited to the above-mentioned constitutions, and various modifications are conceivable without departing from the technical concept of the present invention.

According to the cold cathode fluorescent lamp of the present invention, by setting a total amount and a mixing ratio of a bonding agent which is made of aluminum oxide and boron oxide and a particle size of aluminum oxide to values which respectively fall within desired ranges, it is possible to acquire a high optical flux maintenance factor due to a phosphor protection effect obtained by aluminum oxide, and it is also possible to manufacture the cold cathode fluorescent lamp using steps substantially equal to corresponding steps of the related art. Further, the present invention can also acquire an advantageous effect that the glass tube can withstand a bending step due to a low-temperature melting property which boron oxide possesses.

DESCRIPTION OF THE PREFERRED EMBODIMENTS

Hereinafter, a preferred embodiment of the present invention is explained in detail in conjunction with drawings which show the embodiment.

Figure 1:
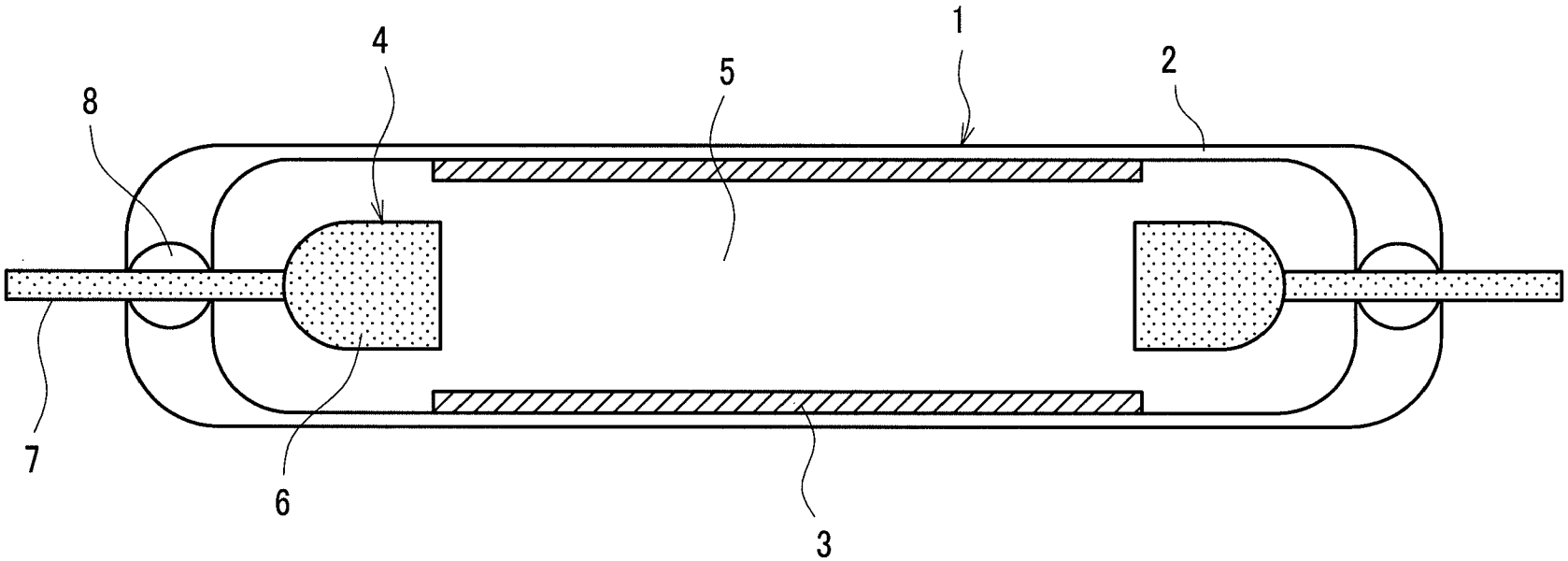
FIG. 1 is a cross-sectional view of an essential part showing the constitution of one embodiment of a cold cathode fluorescent lamp according to the present invention.
Figure 2:
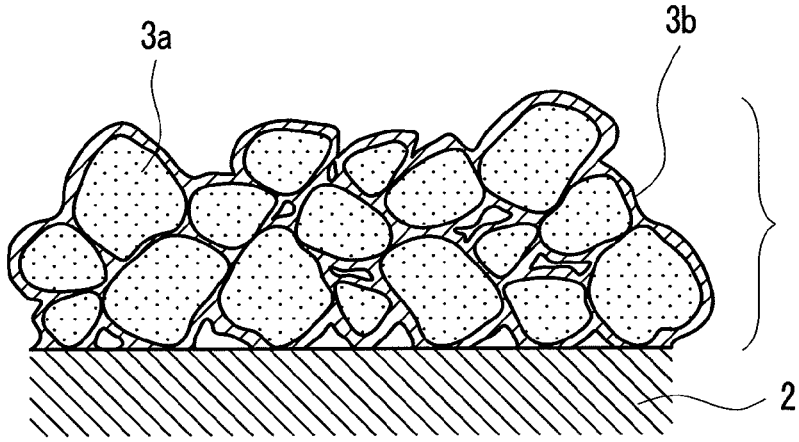
FIG. 2 is an enlarged cross-sectional view of an essential part of a phosphor layer shown in FIG. 1.

FIG. 1 is an enlarged cross-sectional view of an essential part showing the constitution of a cold cathode fluorescent lamp according to an embodiment of the present invention, and FIG. 2 is an enlarged cross-sectional view of a phosphor layer shown in FIG. 1. In FIG. 1 and FIG. 2, a cold cathode fluorescent lamp 1 is configured such that, on an inner surface (a glass surface) of a light transmitting glass tube (hereinafter, referred to as a glass tube) 2 which is formed using borosilicate glass, for example, a phosphor layer 3 is formed by bonding. Here, the phosphor layer 3 is constituted such that a bonding agent 3*b* which is a mixed fluid dispersion formed by mixing aluminum oxide and boron oxide is applied to surfaces of a plurality of phosphor particles 3*a* by coating.

Here, with respect to the phosphor layer 3, in applying the bonding agent 3*b* to the surfaces of the phosphor particles 3*a* by coating, some phosphor particles 3*a* may not be covered with the bonding agent 3*b* by coating. However, the surfaces of most of phosphor particles 3*a* are covered with the bonding agent 3*b* by coating. Accordingly, due to a baking step of the phosphor layer 3, a dispersion medium in the mixed fluid dispersion are scattered, and the boron oxide containing a low-melting-point glass is melted and is firmly fixed to a glass surface of the glass tube and hence, aluminum oxide in the bonding agent 3*b* is adhered to the surfaces of the phosphor particles 3*a* thus protecting the phosphor particles 3*a*.

Further, in the inside of and at both ends of the glass tube 2, a pair of cold cathodes 4 is arranged to face each other in an opposed manner. Further, a discharge space 5 formed in the inside of the glass tube 2 is evacuated into a vacuum and, thereafter, a Neon (Ne)-Argon (Ar) gas which constitutes a rare gas and mercury are sealed in the discharge space 5.

Further, the pair of cold cathodes 4 is formed as follows. Inner electrodes 6 which are made of a nickel material, a molybdenum material or the like are formed into a cup shape by a press-molding method, for example. The inner electrodes 6 have open ends thereof directed to a main discharge area. Then, to a rear end bottom portion of each inner electrode 6, a power lead line 7 which is made of, for example, nickel-cobalt-ferrous-alloy whose thermal expansion coefficient is close to a thermal expansion coefficient of the glass tube 2 is abutted. Finally, the inner electrodes 6 and the power lead lines 7 are electrically bonded to each other by a resistance welding method or a laser-beam welding method so as to establish the electrical connection between the inner electrodes 6 and the power lead lines 7.

The power lead lines 7 are hermetically sealed to both end portions of the glass tube 2 in a state that the power lead lines 7 are supported on glass beads 8 and hence, the pair of cold cathodes 4 is hermetically sealed to both end portions of the glass tube 2 while allowing the opening ends thereof to face each other in an opposed manner in the main discharge area. Here, the glass tube 2 is formed with a thickness of approximately 1.0 mm to 1.5 mm.

Further, the cold cathode fluorescent lamp 1 is formed such that a body of the glass tube 2 has a wall thickness of approximately 100 μm, for example, and both end portions of the glass tube 2 has a wall thickness of approximately 200 μm to 300 μm. Further, an outer diameter of the glass tube 2 is set to approximately 2.0 mm to 3.0 mm, an inner diameter of the glass tube 2 is set to approximately 2.0 mm to 2.4 mm, and a total length (tube length) of the glass tube 2 is set to approximately 300 mm to 800 mm corresponding to a size of the display panel.

The cold cathode fluorescent lamp 1 having such constitution is formed such that the phosphor layer 3 is firstly formed on an inner surface of the glass tube 2 having, for example, an outer diameter of approximately 2 mm to 3 mm, an inner diameter of approximately 2 mm to 2.4 mm, and a total length (tube length) of approximately 300 mm to 800 mm and, thereafter, steps such as baking of the glass tube 2, formation of the cathode electrodes 4, evacuation of the glass tube 2, filling of a rare gas and mercury and the like follow.

Further, with respect to the formation of the phosphor layer 3, a phosphor suspension which is formed by mixing n-butyl acetate, nitrocellulose, a bonding agent, and light emitting phosphors of respective colors consisting of R (red), G (green) and B (blue) is applied to the inner surface of the light transmitting glass tube 2 by coating and, thereafter, the phosphor suspension is dried to form the phosphor layer 3.

Here, the composition of the bonding agent **3*b* which is mixed into the phosphor layer 3** is made of aluminum oxide and boron oxide, wherein a ratio of the boron oxide is preferably set to a value which falls within a range from approximately 6 wt % to 10 wt % of a total amount of aluminum oxide and boron oxide.

Figure 3:
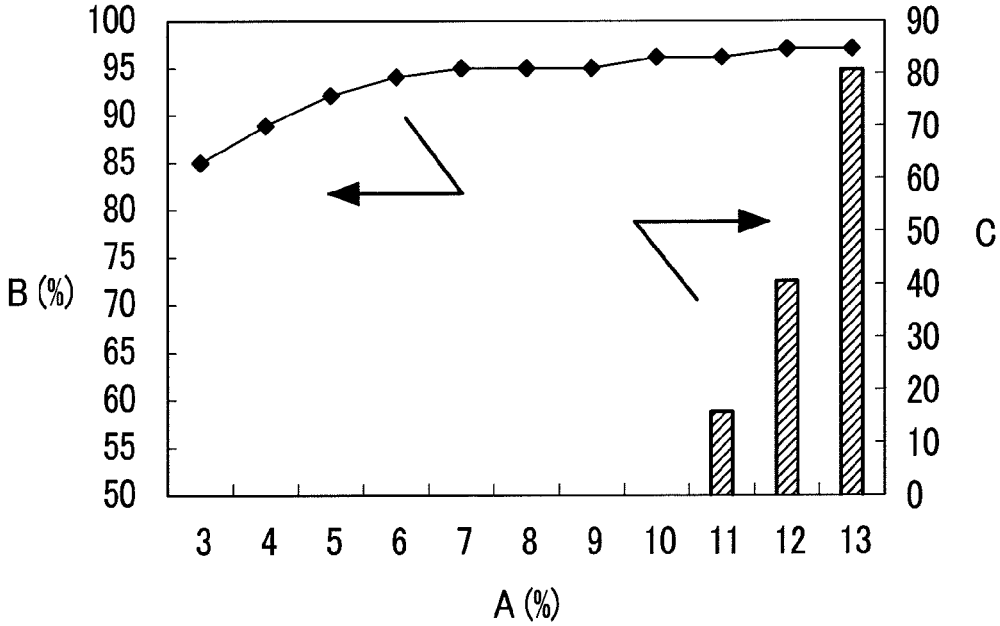
FIG. 3 is a graph showing ratio of boron oxide in a bonding agent shown in FIG. 2, an optical flux maintenance factor of the cold cathode fluorescent lamp after lighting the lamp for 1000 hours and a phosphor-layer peeling frequency at the time of performing a bending operation.

FIG. 3 is a graph showing a relationship among the ratio A (%) of boron oxide in the bonding agent **3*b*, an initial ratio B (%) of an optical flux maintenance factor, and phosphor-layer peeling frequency C at the time of performing bending of the glass tube 2. As shown in FIG. 3, when the ratio of boron oxide is approximately less than 6 wt %, the peeling frequency of the phosphor layer 3 at the time of bending the cold cathode fluorescent lamp 1 is increased and hence, such a ratio of boron oxide is not preferable. Further, when the ratio of boron oxide exceeds approximately 10 wt %, the total optical flux maintenance factor tends to be gradually lowered and hence, such a ratio of boron oxide is also not preferable. Accordingly, it is understood that the ratio of boron oxide is preferably set to a value which falls within a range from approximately 6 wt % to 10 wt % of the total amount of aluminum oxide and boron oxide. Further, the total amount of the bonding agent 3*b* is preferably set to a value which falls within a range from approximately 2 wt % to 10 wt % of the total amount of the phosphor particles 3*a***.

Figure 4:
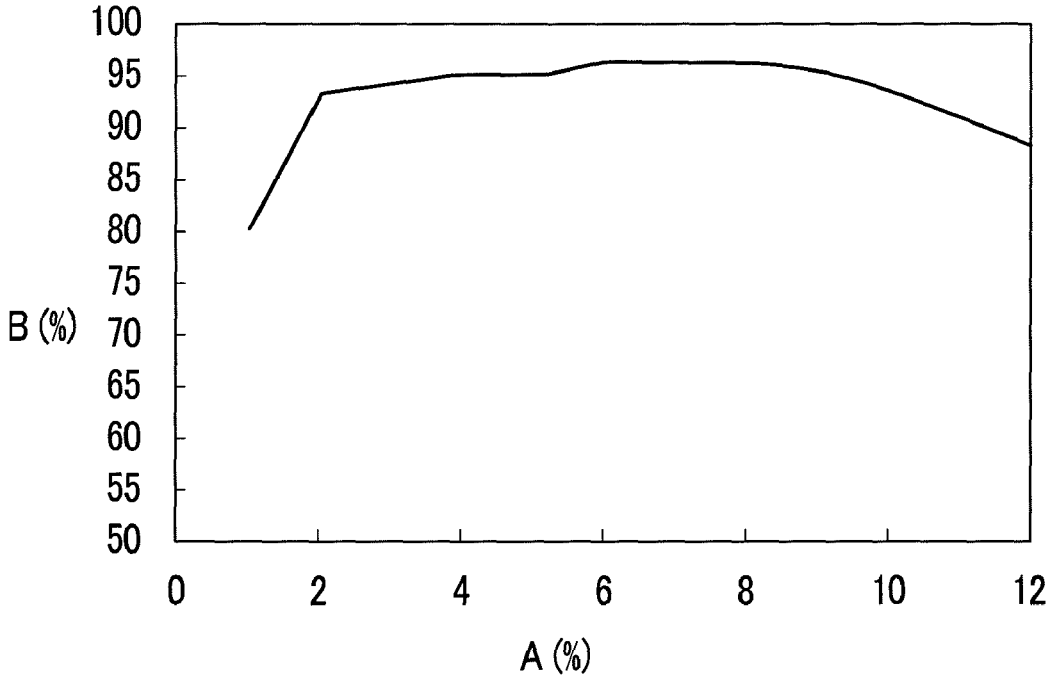
FIG. 4 is a graph showing a relationship among a ratio of the bonding agent with respect to the phosphor, a total optical flux maintenance factor of the cold cathode fluorescent lamp after lighting the lamp for approximately 1000 hours, and an initial brightness (a relative value: the initial brightness when a ratio of the bonding agent is set to approximately 2 wt % being set to 100) of the cold cathode fluorescent lamp.

FIG. 4 is a graph showing a relationship among a ratio of the bonding agent **3*b* with respect to the total amount of the phosphor particles 3*a* (phosphor ratio) A (%), the total optical flux maintenance factor after lighting the lamp 1 for approximately 1000 hours, and initial brightness (a relative value: the initial brightness when a ratio of the bonding agent is set to approximately 2 wt % being set to 100) B (%). As shown in FIG. 4, when the ratio of the bonding agent 3*b* is less than 2 wt %, an amount of aluminum oxide necessary for protecting the phosphor particles 3*a* becomes insufficient and hence, the deterioration of the phosphor particles 3*a* is increased whereby the optical flux maintenance factor is largely lowered. Accordingly, setting of the ratio of the bonding agent 3*b*** to less than 2 wt % is not desirable.

Further, there is a tendency that the initial brightness is gradually lowered corresponding to the increase of the ratio of the bonding agent **3*b*. This is because along with the increase of the amount of aluminum oxide, an amount of diffusion reflection component is gradually increased and hence, an amount of ultraviolet rays which arrive at the phosphor particles 3*a* is gradually decreased. Further, when the ratio of the bonding agent 3*b* exceeds approximately 10 wt %, a lowering amount of the initial brightness is large such that the initial brightness is lowered to a value smaller than approximately 95% and hence, it is not desirable to set the ratio of the bonding agent 3*b* to a value which exceeds 10 wt %. Accordingly, it is understood that the ratio of the bonding agent 3*b* with respect to the total amount of the phosphor particles 3*a*** is preferably set to a value which falls within a range from approximately 2 wt % to 10 wt %.

Further, when a primary particle size (single-body particle size) of aluminum oxide is increased, a gap between the particles becomes large and hence, an area of the phosphor particles **3*a* covered with the bonding agent 3*b*** by coating is substantially decreased. As a result of the investigation which is performed by changing the particle size of aluminum oxide into several sizes, it is understood that, when the particle size exceeds approximately 200 nm, the protection effect is decreased and the lowering of the optical flux maintenance factor is increased. Accordingly, the primary particles size of aluminum oxide is preferably set to approximately 200 nm or less.

Embodiment 1

As the fluid dispersion of the bonding agent **3*b*, a fluid dispersion which is obtained by dispersing approximately 9 wt % of aluminum oxide having a primary particle size of approximately 20 nm and approximately 1 wt % of boron oxide in n-butyl acetate is prepared. The fluid dispersion is added to the phosphor particles 3*a* such that the ratio of the bonding agent 3*b* becomes approximately 2 wt % with respect to the total amount of the phosphor particles 3*a*, and the phosphor particles 3*a*** and the fluid dispersion are mixed together with n-butyl acetate and nitrocellulose thus producing a phosphor suspension. Thereafter, the cold cathode fluorescent lamp is manufactured using existing steps explained above.

Embodiment 2

As the fluid dispersion of the bonding agent **3*b***, a fluid dispersion which is obtained by dispersing approximately 14 wt % of aluminum oxide having a primary particle size of approximately 20 nm and approximately 1 wt % of boron oxide in n-butyl acetate is prepared. The fluid dispersion is added to the phosphor particles 3*a* such that the ratio of the bonding agent 3*b* becomes approximately 6 wt % with respect to the total amount of the phosphor particles 3*a*, and the phosphor particles 3*a* and the fluid dispersion are mixed together with n-butyl acetate and nitrocellulose thus producing a phosphor suspension. Thereafter, the cold cathode fluorescent lamp is manufactured using existing steps explained above.

COMPARISON EXAMPLE 1

As a fluid dispersion of the bonding agent 3*b*, a mixed fluid dispersion consisting of calcium pyrophosphate ($Ca_2P_2O_7$) and CBB ($CaO.BaO.B_2O_3$) which are generally used for manufacturing of a cold cathode fluorescent lamp is prepared. The mixed fluid dispersion is added to the phosphor particles 3*a* such that a ratio of the bonding agent 3*b* becomes approximately 2 wt % with respect to the total amount of the phosphor particles 3*a*, and the phosphor particles 3*a* and the fluid dispersion are mixed together with n-butyl acetate and nitrocellulose thus producing a phosphor suspension. Thereafter, the cold cathode fluorescent lamp is manufactured using existing steps explained above.

COMPARISON EXAMPLE 2

As the fluid dispersion of the bonding agent 3*b*, an n-butyl acetate fluid dispersion containing only aluminum oxide having a primary particle size of approximately 20 nm is prepared. The fluid dispersion is added to the phosphor particles 3*a* such that a ratio of the bonding agent 3*b* becomes approximately 2 wt % with respect to a total amount of the phosphor particles 3*a*, and the phosphor particles 3*a* and the fluid dispersion are mixed with n-butyl acetate and nitrocellulose thus producing a phosphor suspension. Thereafter, the cold cathode fluorescent lamp is manufactured using existing steps explained above.

Following Table 1 shows optical flux maintenance factors of the cold cathode fluorescent lamps which are manufactured in the respective embodiments and the comparison examples after lighting the lamps for approximately 1000 hours, and the peeling frequency of the phosphor layer at the time of bending the cold cathode fluorescent lamp.

TABLE 1

| | Ratio of bonding agent (wt %) | Ratio of boron oxide (wt %) | brightness maintenance factor (after 1000 h) (%) | phosphor-layer peeling frequency |
|---|---|---|---|---|
| Embodiment 1 | 2 | 10 | 93 | 0 |
| Embodiment 2 | 6 | 6.7 | 95 | 0 |
| Comparison example 1 | 2 | | 85 | 0 |
| Comparison example 2 | 2 | | 93 | 100 |

As can be clearly understood from Table 1, with the use of the bonding agent 3*b*, the phosphor layer 3 according to the present invention can realize a cold cathode fluorescent lamp 1 which exhibits a high optical flux maintenance factor, and can prevent peeling-off of the phosphor at the time of bending the glass tube 2 into a U-shape or an L-shape.

Here, boron oxide in the bonding agent 3*b* which is applied to the phosphor particles 3*a* by coating contains low-melting-point glass and hence, the bonding agent 3*b* exhibits extremely high bonding property to glass. Further, boron oxide has a function of being hardened when a softening temperature of the boron oxide is low and being softened when the softening temperature of the boron oxide is high and hence, there is no possibility that the phosphor layer 3 is peeled off at the time of bending the cold cathode fluorescent lamp 1 into a U-shape or an L-shape.

Here, in the above-mentioned embodiments, the explanation has been made with respect to the case in which the bonding agent 3*b* which is applied to the phosphor particles 3*a* by coating is made of aluminum oxide and boron oxide. However, it is needless to say that advantageous effects substantially equal to the above-mentioned advantageous effects can be obtained even when the bonding agent 3*b* made of borate or a mixture of boron oxide and borate is used in place of boron oxide.

Along with the recent large-sizing of the liquid crystal television receiver set, a demand for a backlight which exhibits higher brightness and lower power consumption has been steadily increasing. To cope with such a demand using a cold cathode lamp, the enhancement of brightness using a single tube or the decrease of the number of lamps is considered. For this end, the application of a high voltage to the fluorescent lamp, the supply of a large current to the fluorescent lamp and bending of an elongated lamp are indispensable. Accordingly, the suppression of lowering of brightness (the suppression of lowering of the optical flux maintenance factor) at the time of lighting the fluorescent lamp for a long time and the prevention of the peeling-off of the phosphor layer at the time of performing a bending operation become extremely important. The present invention is expected to acquire advantageous effects which can sufficiently satisfy these demands.

What is claimed is:

1. A cold cathode fluorescent lamp comprising:

a light transmitting glass tube in which a rare gas and mercury are sealed;

a pair of cold cathodes which is arranged in both end portions of the glass tube in a sealed manner in a state that the cold cathodes face each other in an opposed manner;

a pair of power lead lines each of which has one end thereof connected to the cold cathode and another end thereof led out to the outside of the glass tube in a hermetically sealed manner; and a phosphor layer which is formed on an inner surface of the glass tube, wherein the phosphor layer is constituted of a plurality of phosphor particles and a bonding agent, the bonding agent is made of aluminum oxide and boron oxide, and the plurality of phosphor particles are bonded to the inner surface of the glass tube in a state that the plurality of phosphor particles are covered with the bonding agent by coating, and a ratio of boron oxide in the bonding agent is set to a value which falls within a range from 6 wt % to 10 wt % of a total amount of aluminum oxide and boron oxide.

2. A cold cathode fluorescent lamp according to claim 1, wherein an amount of the bonding agent in the phosphor layer is set to a value which falls within a range from 2 wt % to 10 wt % with respect to a total amount of the phosphor particles.

3. A cold cathode fluorescent lamp according to claim 1, wherein a primary particle size of aluminum oxide is set to 200 nm or less.

* * * * *